US012484730B2

(12) United States Patent
Davison

(10) Patent No.: US 12,484,730 B2
(45) Date of Patent: Dec. 2, 2025

(54) MAIL AND PACKAGE THEFT PREVENTION DEVICE, SYSTEM, AND METHOD

(71) Applicant: Isaac Davison, Moss Point, MS (US)

(72) Inventor: Isaac Davison, Moss Point, MS (US)

( * ) Notice: Subject to any disclaimer, the term of this patent is extended or adjusted under 35 U.S.C. 154(b) by 0 days.

(21) Appl. No.: 18/428,222

(22) Filed: Jan. 31, 2024

(65) Prior Publication Data

US 2024/0251981 A1 Aug. 1, 2024

Related U.S. Application Data

(60) Provisional application No. 63/482,388, filed on Jan. 31, 2023.

(51) Int. Cl.

| | |
|---|---|
| ***A47G 29/22*** | (2006.01) |
| ***A47G 29/12*** | (2006.01) |
| ***A47G 29/124*** | (2006.01) |
| ***A47G 29/126*** | (2006.01) |
| ***A47G 29/16*** | (2006.01) |

(52) U.S. Cl.

CPC ..... *A47G 29/22* (2013.01); *A47G 29/12095* (2017.08); *A47G 29/1248* (2017.08); *A47G 29/126* (2013.01); *A47G 29/16* (2013.01); *A47G 2029/1257* (2017.08)

(58) Field of Classification Search

CPC ..... A47G 29/12095; A47G 29/1248; A47G 29/1251; A47G 29/14; A47G 29/16; A47G 29/22; A47G 29/1245; A47G 29/126; A47G 29/1216; A47G 2029/1257; A47G 29/20

See application file for complete search history.

(56) References Cited

U.S. PATENT DOCUMENTS 27,466 A * 3/1860 North ..... A47G 29/12095 232/47
378,955 A * 3/1888 Dubey ..... A47G 29/1207 193/8
476,692 A * 6/1892 Shuman ..... A47G 29/12095 232/54
476,971 A * 6/1892 Askam ..... A47G 29/12095 232/49
D195,373 S * 6/1963 Dwyer ..... D99/28
3,833,168 A * 9/1974 Sackrison ..... A47G 29/1216 232/39
5,190,214 A * 3/1993 Dewailly ..... A47G 29/1216 239/323
D337,415 S * 7/1993 McDowell ..... D99/28
5,351,883 A 10/1994 Pachl (Continued)

*Primary Examiner* — William L Miller

(74) *Attorney, Agent, or Firm* — Dunlap Bennett & Ludwig, PLLC

(57) ABSTRACT

A package theft prevention system comprising a mailbox defining an irregularly shaped interior compartment for storage of received packages. The lower portion of the mailbox has an outward, distally tapering wall for anchoring to concrete it is embedded in. The uppermost opening to the mailbox has a package door biased in the closed condition, where, just downward of the package door is a self-closing trap door biased in its closed position. As the package door and the trap door are offset and open in opposing directions, removal of packages from the upper opening is frustrated while receipt by the deliverer is facilitated. A lockable rear door below the upper opening provides access to the interior compartment for the owner.

5 Claims, 9 Drawing Sheets

(56) References Cited

U.S. PATENT DOCUMENTS 5,411,206 A * 5/1995 Latham ..... A47G 29/1216 232/39
5,435,484 A * 7/1995 Carlson ..... A47G 29/1251 232/47
5,597,116 A 1/1997 Morris
5,617,993 A 4/1997 Morris
5,833,132 A * 11/1998 Bachmeier ..... A47G 29/12095 232/47
5,850,967 A * 12/1998 White ..... A47G 29/12095 232/17
D414,309 S * 9/1999 Okafor ..... D99/29
5,992,736 A 11/1999 Parker
6,109,519 A 8/2000 McClure
6,244,505 B1 6/2001 Grimes et al.
6,299,061 B1 10/2001 Henson
6,375,071 B1 4/2002 Kim
6,840,438 B2 1/2005 Hassan
6,974,074 B1 12/2005 Watts
7,036,719 B1 5/2006 Helphrey et al.
7,051,921 B1 5/2006 Borgognone
7,175,071 B1 * 2/2007 Slagle ..... A47G 29/16 232/17
D546,525 S * 7/2007 Akinto ..... D99/29
7,249,705 B2 7/2007 Dudley
7,854,374 B2 12/2010 Dudley
8,020,752 B2 * 9/2011 Hjorth ..... A47G 29/1251 232/47
8,485,424 B1 7/2013 Taylor
10,251,503 B1 * 4/2019 Fulps ..... A47G 29/1251
10,709,275 B2 7/2020 Bolles
11,141,014 B2 10/2021 James
11,253,095 B2 * 2/2022 Carlson ..... A47G 29/16
11,503,936 B2 * 11/2022 Leng ..... A47G 29/1251
11,583,125 B1 * 2/2023 Kachan ..... A47G 29/1251
2014/0209669 A1 * 7/2014 Richardson ..... A47G 29/1216 232/39
2020/0237132 A1 * 7/2020 Kaechele ..... A47G 29/141
2023/0355019 A1 * 11/2023 Shamp ..... A47G 29/20

* cited by examiner

MAIL AND PACKAGE THEFT PREVENTION DEVICE, SYSTEM, AND METHOD

CROSS-REFERENCE TO RELATED APPLICATION

This application claims the benefit of priority of U.S. provisional application No. 63/482,388, filed 31 Jan. 2023, the contents of which are herein incorporated by reference.

BACKGROUND OF THE INVENTION

The present invention relates to mailboxes and, more particularly, an improved mailbox adapted to prevent theft of packages and mail received therein.

Mail and package theft has soared in concert with the increase in online shopping. Also according to reports, porch piracy is widely regarded as a difficult crime to resolve, with a mere 10% of cases resulting in an arrest by the police. Therefore, a significant number of these incidents remain unsolved.

Conventional mailboxes lack the proper security for preventing mail or packages being stolen as thieves can either take the entire mailbox, break the mailbox, or just steal the packages that do not fit in the mailbox.

As can be seen, there is a need for an improved mailbox adapted to prevent theft of packages and mail received therein.

SUMMARY OF THE INVENTION

The mailbox embodied in the present invention contemplates a full mailbox embedded in concrete approximately two to four feet in the ground.

The present invention mailbox has biased trap door between the package reception point and the interior compartment allowing delivery vendors to insert the package therein by preventing others from removing the package from the same reception point.

The mailbox is dimensioned, weighted, and adapted to prevent a body (even that of a child) from climbing or getting into the mailbox.

The owner can access the packages via a rear lockable door.

The improved mailbox may have an envelope slot located on the front of the mailbox that receives mail by lifting a lid to expose a mail slot.

As such, the improved mailbox of the present invention puts control back into the owner's hand as they need not worry if their mail will be there or not.

In one aspect of the present invention, a package theft prevention system, the system includes the following: a body having an upper portion and a lower portion, wherein the lower portion has a greater cross-section than the upper portion; each portion providing a plurality of walls, wherein at least one wall of the plurality of walls of the lower portion taper distally as it extends from the upper portion so that said wall projects distally from a profile of the upper portion, wherein the lower portion is embedded in concrete so that said wall resists removal of the lower portion from the concreate embedment.

In another aspect of the present invention, the package theft prevention system further includes the following: an upper opening at an upper end of the upper portion; a package door pivotably connected to the upper opening so as to be movable between an open position and a closed position; and a trap door disposed within the upper portion below the upper opening, wherein the trap door is pivotably movable between an open position and a closed position, wherein the trap door is biased in the closed position, and wherein movement to the open position is in a downward direction, wherein the open position of the package door is in an upward direction, wherein the package door is biased in the closed position; further including a weighted guideline that biases the package door in the closed position, wherein the package door and the trap door are connected, respectively, to opposing walls of the plurality of walls; further including a rear door disposed along a rear wall of the plurality of walls and below the trap door and the package door, wherein the rear door is movable between a locked engagement and an unlocked engagement; further including a mail slot along a front wall of the plurality of walls, wherein the mail slot is disposed at an elevation between the trap door and the rear door; and further including a mail door pivotably associated to the mail slot so as to move between an open disposition and a closed disposition covering the mail slot.

In yet another aspect of the present invention, a method of preventing package theft includes embedding the above-mentioned package theft prevention system in concrete.

These and other features, aspects and advantages of the present invention will become better understood with reference to the following drawings, description, and claims.

DETAILED DESCRIPTION OF THE INVENTION

Figure 1:
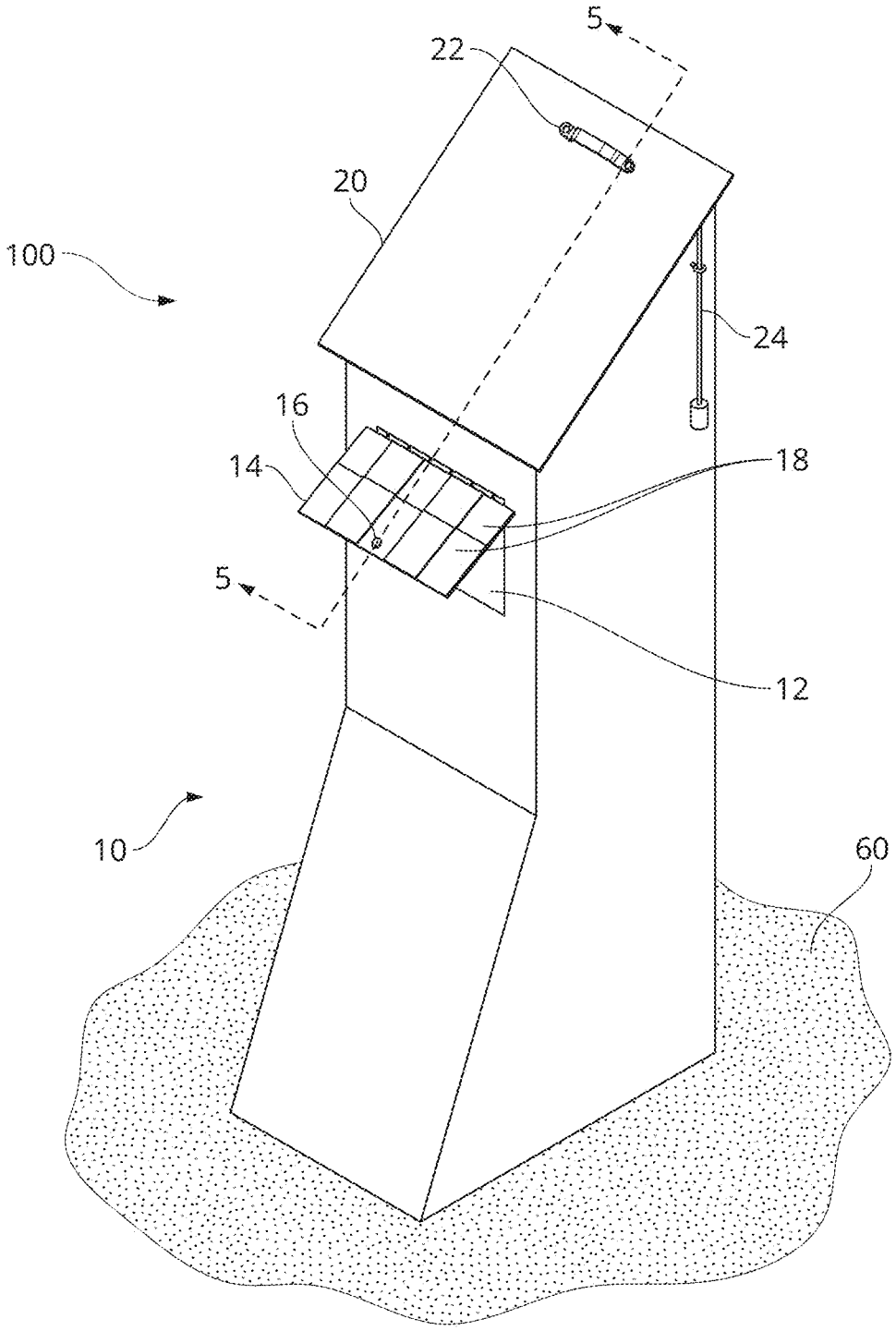
FIG. 1 is a front perspective view of an exemplary embodiment of the present invention.
Figure 2:
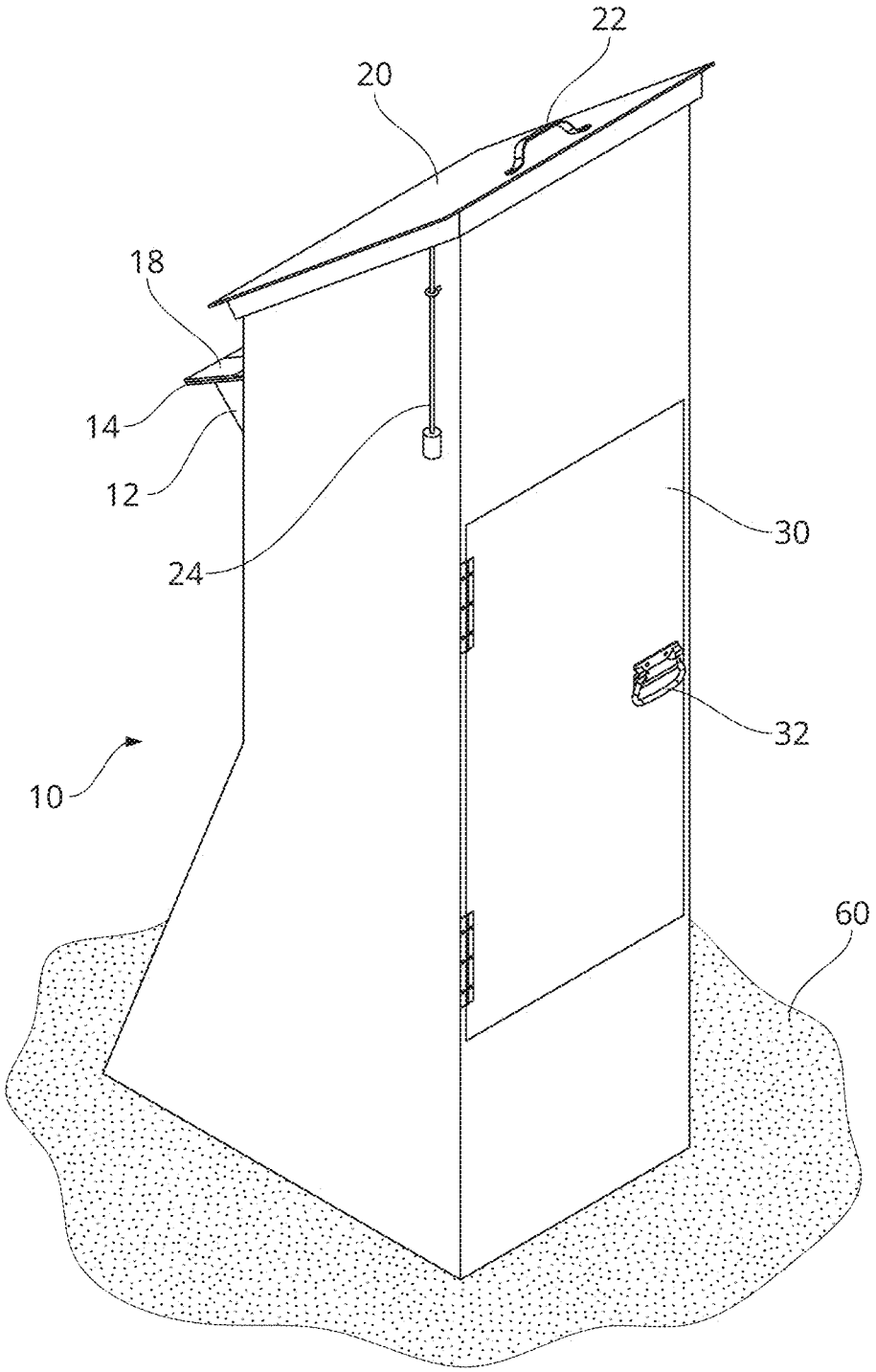
FIG. 2 is a rear perspective view of an exemplary embodiment of the present invention.
Figure 3:
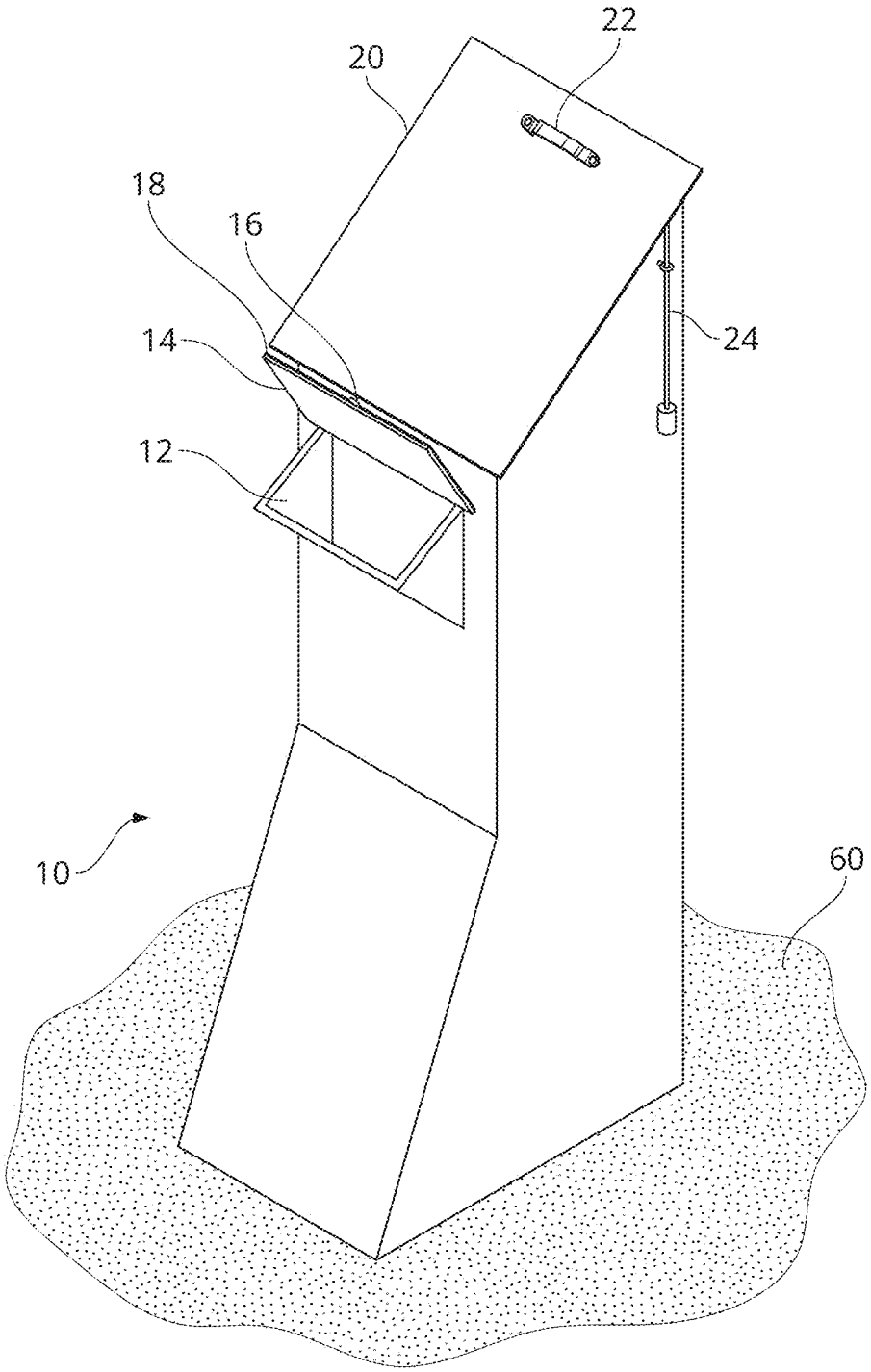
FIG. 3 is a front perspective view of an exemplary embodiment of the present invention, showing a mail door 14 in an open disposition.
Figure 4:
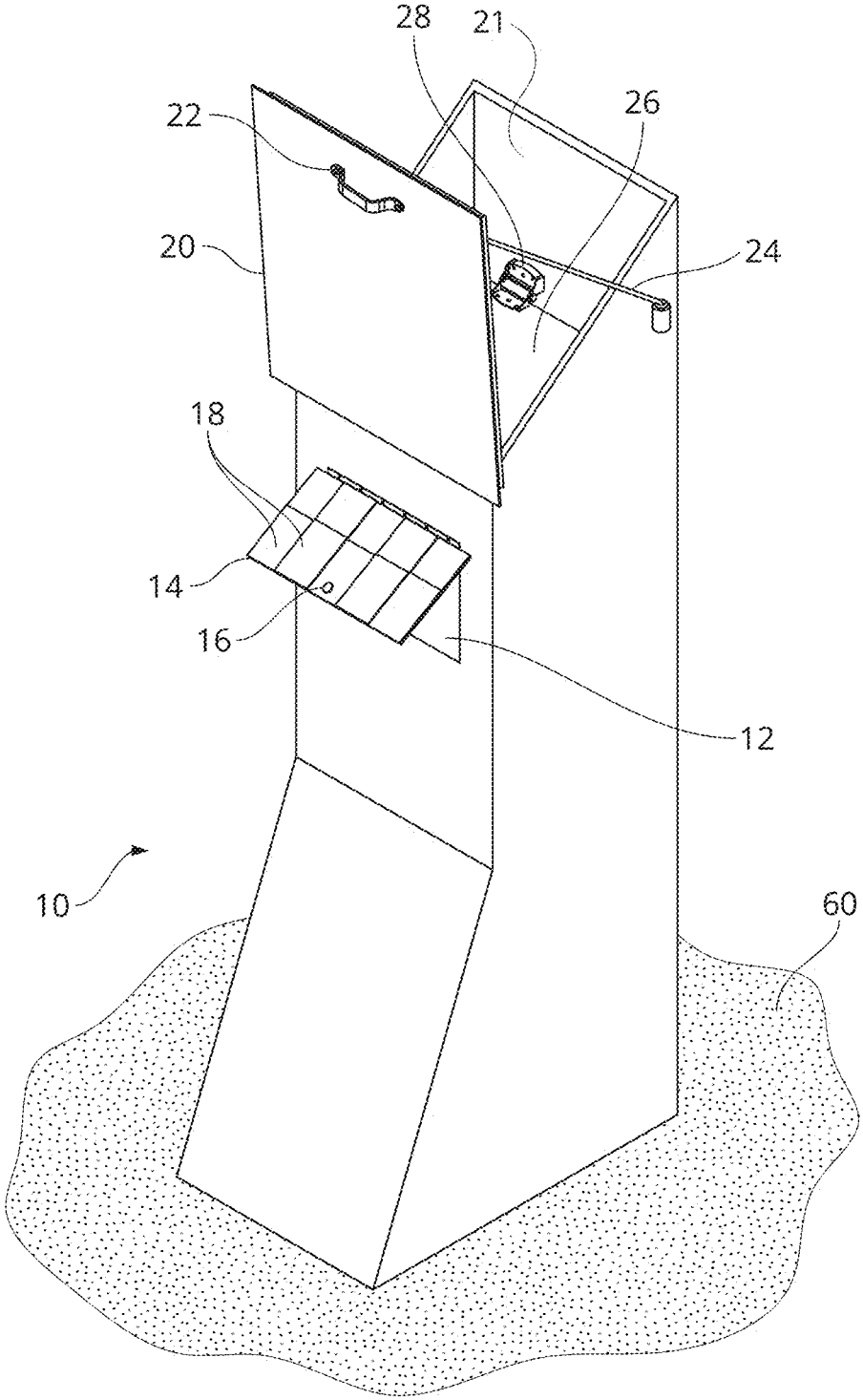
FIG. 4 is a front perspective view of an exemplary embodiment of the present invention, showing a package door 20 in a raised condition.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Referring to FIGS. 1 through 7, the present invention may include a mailbox 100 having a body 10 that may be embedded in concrete approximately two to four feet in the ground. The body 10 may include a plurality of walls that define an interior compartment 34 for storing packages or mail. The body 10 and thus the compartment 34 may have an upper portion 40 and a lower portion 50. The cross-section of the upper portion 40 may be less than a cross-section of the lower portion 50. While the upper portion 40 may have a uniform cross-section throughout its length, the cross-section of the lower portion 50 may increase as the lower portion 50 extends downward. Specifically, the lower portion 50 may taper distally as it extends downward, thereby forming a wedge, which would make pulling the mailbox 100 from its concrete embedment (not shown) more challenging as the outwardly sloping wall would contact surrounding concrete.

Accordingly, the hollow cross-section of the lower portion 50 is greater than that of the upper portion 40, thereby the lower portion 50 provides more space for storing mail and packages that may pile up over multiple deliveries. It is understood that other arrangements, dimensions, and shapes are contemplated herein as long as the improved mailbox 100 functions as disclosed herein.

Figure 6:
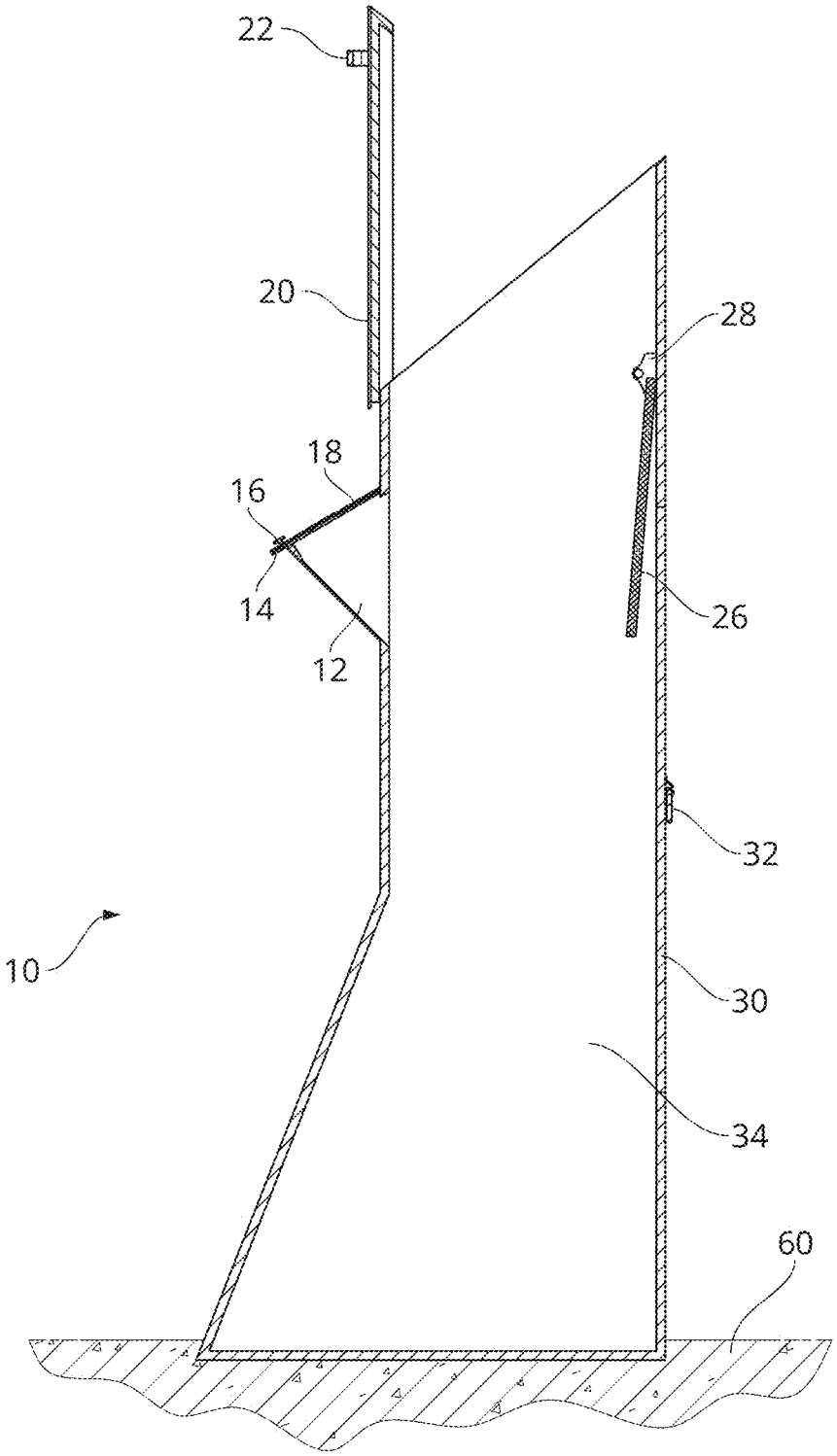
FIG. 6 is the section view of FIG. 5 showing the package door 20 in the raised position and a trap door 26 in an open position.
Figure 7:
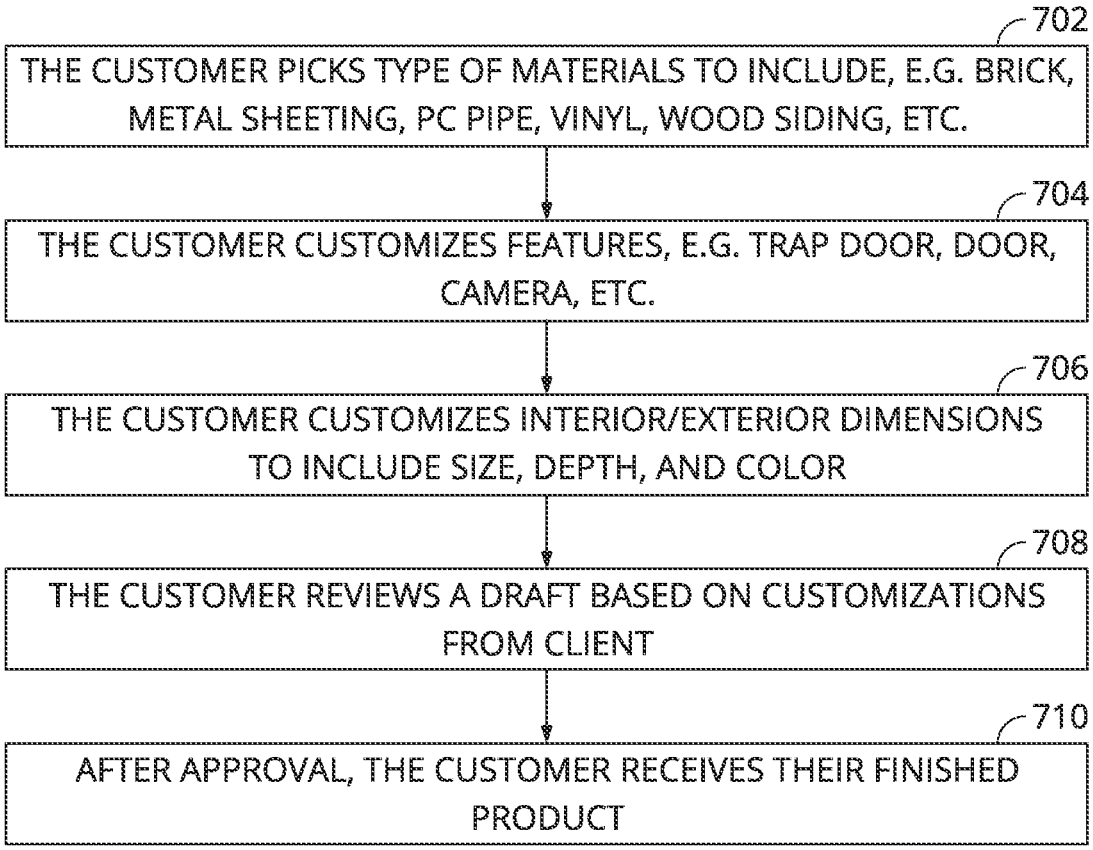
FIG. 7 is a flow chart of a method of customizing an exemplary embodiment of the present invention.

At the upper end of the upper portion 40 is an upper opening 21 that communicates the interior compartment 34 with the external environment. The upper opening 21 may be covered by a package door 20. The package door 20 may be disposed, at rest, in a sloped oriented. In such an embodiment, the rear wall may be at a higher elevation relative to the front wall, as illustrated in the Figures (though other orientations of the package door 20 and walls, including a horizontal orientation are contemplated even if not shown in the exemplary Figures). The package door 20 may have a handle 22 for moving the package door between an open condition and a closed condition in the sloped orientation. In the open condition, the package door 20 may be in a substantially vertically upward orientation as shown in FIG. 6. The package door 20 may be pivotably connected to the front wall to facilitate its movement between the open and closed conditions.

The package door 20 may have a guideline 24 with weight secure to the package door 20, preventing it from remaining in the open position after deliveries may be an alternative. The guideline 24 with weight biases the package door 20 in the closed condition.

Figure 5:
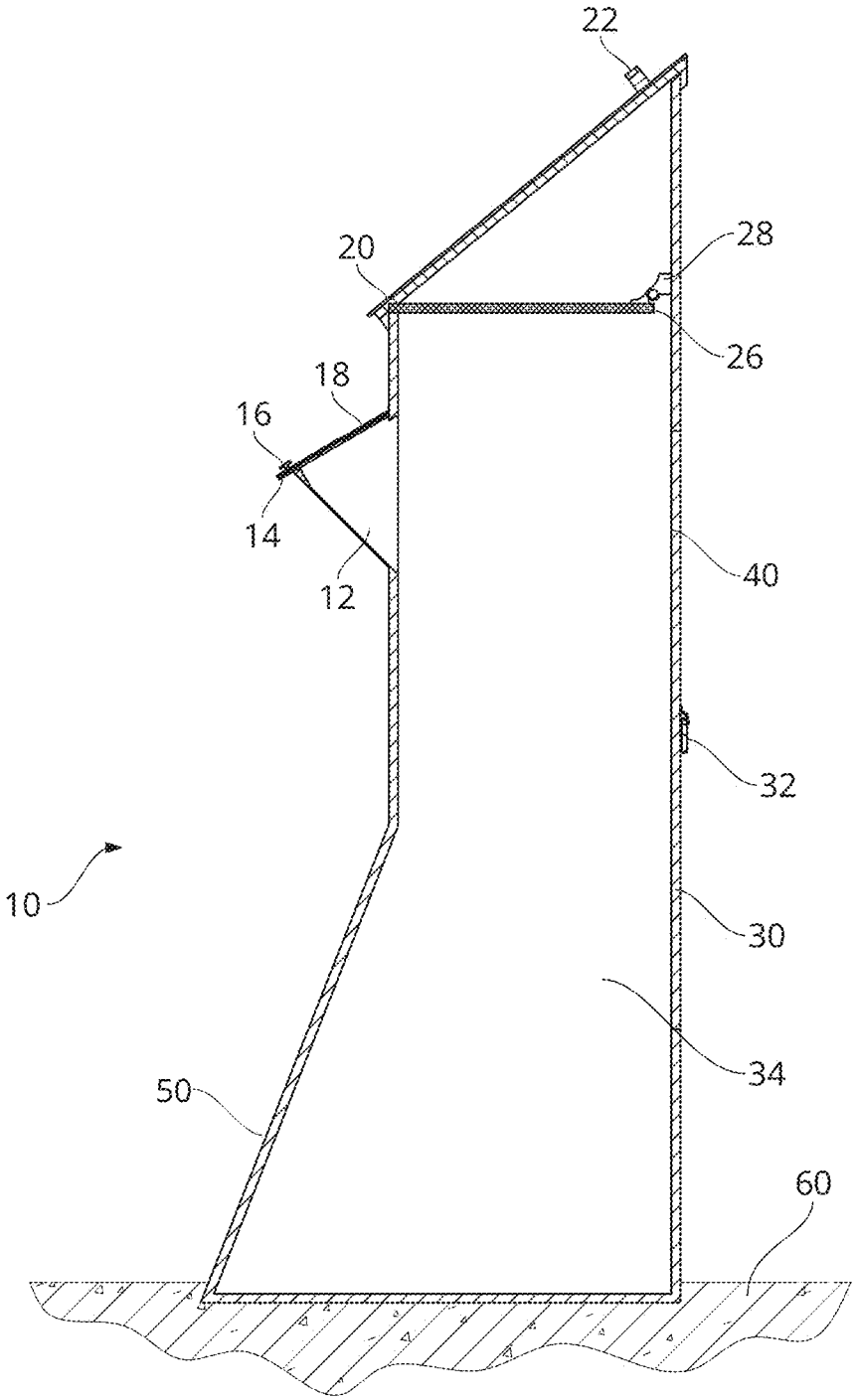
FIG. 5 is a section view taken along ling 5-5 in FIG. 1.

A trap door 26 may be disposed across a hollow portion of the upper portion 40. The trap door 26 may be pivotably connected to an inner surface of the upper portion by way of a self-closing hinge 28 so that the trap door 26 is pivotable between a closed position, providing a barrier to the lower portion of the interior compartment 34, and an open position providing access to the lower portion of the interior compartment 34. The self-closing hinge 28 may be spring-loaded or otherwise biased in the closed position. In the open position the trap door 26 may be moved to a less than vertically downward orientation, as shown in FIG. 6. The trap door 26 may be disposed just downward of an upper opening of the interior compartment 34, as shown in FIG. 5. The trap door 26 may be horizontally oriented and disposed just downward of the lowest point of the upper opening.

The pivotable connection point of the package door 20 may be along a wall opposite the self-closing hinge 28—e.g., the self-closing hinge 28 connection point is located along the rear wall, while the pivotable connection point of the package door 20 may be disposed along the front wall, whereby this opposing arrangement of pivotably biased doors critically makes removing packages from the internal compartment 34 via the upper opening 21 as challenging as possibly, while not frustrating the deliverer from inserting the package into the interior compartment 34 in the first place.

A mail slot 12 may be disposed in the front wall so that it communicates the interior compartment 34 with the external environment. The mail slot 12 may be disposed below the lowest point of the trap door 26. A mail door 14 may be disposed over the mail slot 12 so that the mail door moves between an open disposition and closed disposition covering the mail slot 12. The movement between the open and closed dispositions may be facilitated by a mail door pull 16. The mail door 14 may have decorative shingles 18.

Along the rear wall, a rear door 30 is provided for accessing the lower portion of the interior compartment 34; thus, the rear door 30 is at a lower elevation than the package door 20, the trap door 26, and the mail door 12. The rear door 30 is movable between an open arrangement and a closed arrangement. In the closed arrangement, the rear door may be locked and unlocked by way of a key. A rear door handle 32 may be provided for facilitating the movement between the open and closed arrangements. A locking device may be associated with the rear door 30 or its pivotable connection so that, in the closed arrangement, the back door 30 may be toggled between a locked condition and an unlocked condition.

In use, a package deliverer may open the package door 20 to the open condition and urge a package past the closed-position-biased trap door 26 and into the interior compartment 34. Immediately after the package clears the trap door 26 it self-closes.

Figure 8:
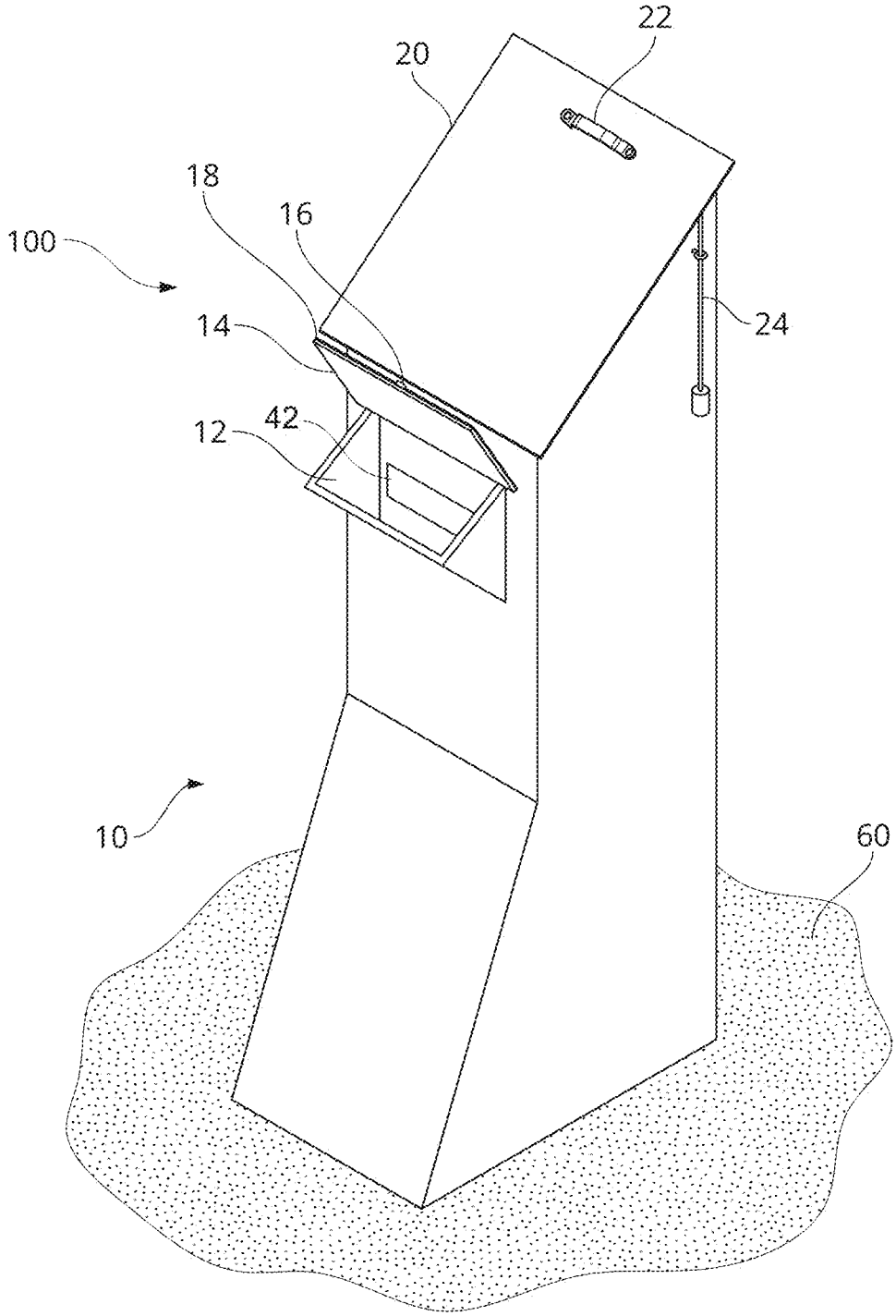
FIG. 8 is a front perspective view of an alternative embodiment of the present invention, showing a mail door 14 in an open disposition.
Figure 9:
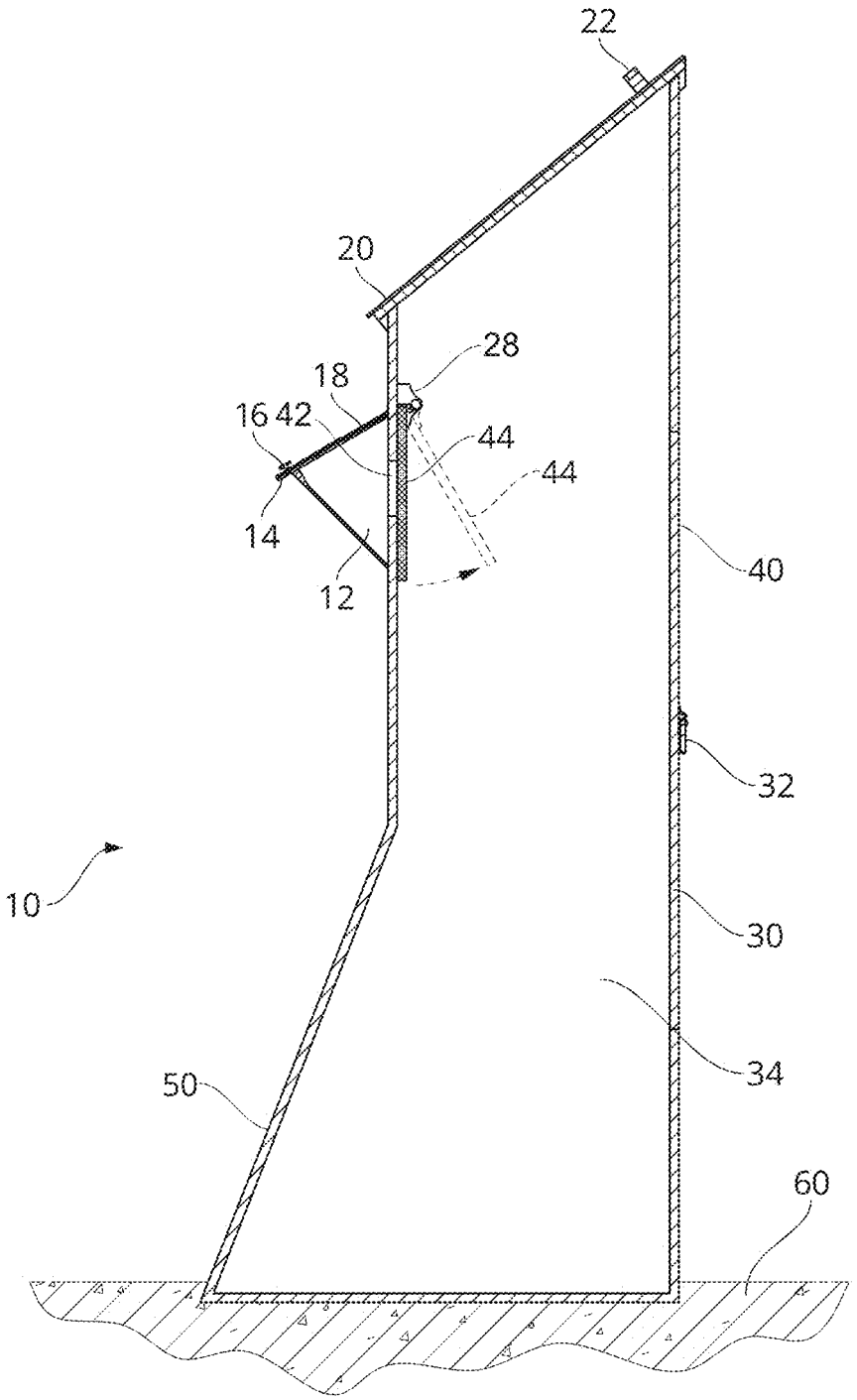
FIG. 9 is a section view of FIG. 8

In certain embodiments, referring to FIGS. 8 and 9, the mail slot 12 may 12 may provide an aperture 42, which is the only opening that communicates with the interior compartment 34 from the "front" of the mailbox 100. Furthermore, a front trap door 44 may be attached by a spring hinge 28 just upward of the mail slot 12 to the interior front wall of said mailbox 100 so that in the open position, the front trap door 44 covers a portion or an entirety of the mail slot 12, and the entirety of the aperture 42. Accordingly, when the mail personnel push a letter or other correspondence through the aperture urges the front tap door 44 is urged back, see FIG. 9, to a closed position, closing off the upper access to the interior compartment 34.

Different components of the improved mailbox 100 may be made of or comprise brick, wood, metallic materials, plasticized material, or other suitable materials. The relationships between the components are illustrated in the flow chart of FIG. 7. The dimensions and material types may be varied based on need, demand, environmental limitations, aesthetics, and the like.

The present invention may be used to solve the rising problems of porch pirates taking packages and leaving the vendor, delivery service provider and homeowner out in the dark about what to do. Also, the present invention can be used for any products needing extra security with storage.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A package theft prevention system, the system comprising;

a body having an upper portion and a lower portion, wherein the lower portion has a greater cross-section than the upper portion;

each portion providing a plurality of walls, wherein at least one wall of the plurality of walls of the lower portion tapers distally as it extends from the upper portion so that said at least one wall projects distally from a profile of the upper portion, wherein the lower portion is embedded in concrete so that said at least one wall resists removal of the lower portion from the concrete;

an upper opening at an upper end of the upper portion;

a package door pivotably connected to the upper opening so as to be movable between an open position and a closed position;

a weighted guideline operatively associated with the package door so that the package door is biased in the closed position;

a trap door disposed within the upper portion below the upper opening, wherein the trap door is pivotably movable between an open position and a closed position; and a spring hinge operatively associated with the trap door so that the trap door is biased in the closed position, and wherein movement to the open position of the trap door is in a downward direction, wherein the open position of the package door is in an upward direction.

2. The system of claim 1, wherein the package door and the trap door are connected, respectively, to opposing walls of the plurality of walls.

3. The system of claim 2, further comprising a rear door disposed along a rear wall of the plurality of walls and below the trap door and the package door; a locking device operatively associated with the rear door so that the rear door is movable between a locked engagement and an unlocked engagement.

4. The system of claim 3, further comprising a mail slot along a front wall of the plurality of walls, wherein the mail slot is disposed at an elevation between the trap door and the rear door.

5. The system of claim 4, further comprising a mail door pivotably associated to the mail slot so as to move between an open disposition and a closed disposition covering the mail slot.

* * * * *